United States Patent [19]

Larson, deceased et al.

[11] 4,434,912

[45] Mar. 6, 1984

[54] ACCUMULATOR FOR VENEER FEEDER

[76] Inventors: Charles L. Larson, deceased, late of Jackson County, Oreg.; by Rocket L. Larson, executor, 606 Benning Dr., Tampa, Fla. 32541

[21] Appl. No.: 292,716

[22] Filed: Aug. 13, 1981

[51] Int. Cl.[3] ..... B65H 1/04; B65H 1/14

[52] U.S. Cl. ..... 221/227; 221/231; 271/157; 414/118

[58] Field of Search ..... 221/227, 231; 414/118, 414/119; 271/157, 158, 159; 198/435

[56] References Cited

U.S. PATENT DOCUMENTS

| | | | |
|---|---|---|---|
| 2,876,009 | 3/1959 | Jeddeloh | 198/435 |
| 3,006,635 | 10/1961 | Elliott et al. | 271/159 X |
| 3,011,619 | 12/1961 | Fields | 198/435 X |
| 3,288,463 | 11/1966 | Stuart | 271/158 |
| 3,369,805 | 2/1968 | Pierson et al. | 271/158 |
| 3,890,185 | 6/1975 | Umazume | 271/159 X |

*Primary Examiner*—F. J. Bartuska

*Attorney, Agent, or Firm*—Kolisch, Hartwell & Dickinson

[57] ABSTRACT

Apparatus for supporting a stack of veneer sheets with the top of such stack at approximately the level of pinch roll mechanism in a dryer feeder. An accumulator in the apparatus may be actuated to support a remnant stack of veneer sheets at proper elevation, and with freeing of a platform in the apparatus whereby it may be lowered to have deposited thereon a new stack of sheets.

10 Claims, 12 Drawing Figures

ACCUMULATOR FOR VENEER FEEDER

BACKGROUND AND SUMMARY

This invention relates to apparatus for supporting a stack of veneer sheets in such a manner that the top of a stack supported is maintained at substantially a predetermined level during the process of removing sheets from the top of the stack (which has the effect of diminishing the height of the stack). The apparatus includes means referred to herein as accumulator means, functioning to support the remnant of a stack from which most of the sheets have been removed with the top of such stack remnant at the desired predetermined level, freeing platform structure which formerly supported the stack whereby such may be supplied with a new stack of sheets. After removal of all sheets in the stack remnant, the top of the newly deposited stack may immediately be placed at the predetermined height desired.

In a more specific sense, the invention concerns apparatus for feeding veneer sheets to a dryer which includes an elevated, power-driven, substantially horizontal pinch roll mechanism, having upper and lower rolls spaced apart from each other to provide a space into which the lead ends of veneer sheets may be placed and movable toward each other to initiate forward motion of such sheets into the dryer. A stack supporting apparatus of the type earlier described is provided in conjunction with such pinch roll mechanism, which may be operated to maintain the top of a stack supported on the apparatus at substantially the level of such pinch roll mechanism. Thus, in feeding sheets, the operator pushes sheets from the top of the stack forwardly to place their ends between the rolls of the pinch roll mechanism, with such rolls separated. In this condition, the sheets which have been partially introduced to the pinch roll mechanism are partially supported by the lower roll in the pinch roll mechanism, and by the stack of veneer sheets which supports the rear ends of the sheets. With the rolls brought together, the sheets progress forwardly, after which the rolls are separated to enable the operation to be repeated.

When the stack of sheets supported on the apparatus becomes nearly depleted, the accumulator means above-described is actuated whereby the remnant of the stack may be maintained at proper elevation for the continued feeding of sheets between the pinch roll mechanism. This support is independent of the platform which formerly supported the stack, which is free to be lowered to receive a new stack of sheets. With a new stack deposited on the platform, and under the remnant of a stack of sheets in the process of being fed to the pinch rolls, the platform may be raised, whereby on the stack remnant becoming fully depleted of sheets, the new stack of sheets is immediately in position to continue the feeding of sheets between the pinch rolls.

In U.S. Pat. No. 2,876,009 issued to Otto G. Jeddeloh, there is disclosed a sheet loading mechanism for a multi-deck conveyor, more specifically a veneer dryer, which includes a pinch roll mechanism comprising a lower, smooth-surfaced steel roll, and an upper, rubber-surfaced roll, which upper roll is movable toward and away from the lower roll. An elevatable platform on the feed side of this pinch roll mechanism supports a stack of veneer sheets with the top of such stack maintained substantially at the height of the pinch roll mechanism. An operator moves sheets from the top of the stack to place ends of the sheets over the lower steel roll, with the rolls of the pinch roll mechanism separated. The rolls of the pinch roll mechanism then move together to initiate forward movement of such sheets into the dryer. No provision, however, is made for holding a nearly depleted stack of veneer sheets with the top of such nearly depleted stack at proper level for feeding between the pinch rolls and with such nearly depleted stack held independently of the platform. As a consequence, all the sheets from a stack supported on the platform must be fed into the dryer before the platform can be reloaded. During reloading of the platform, which requires lowering of the platform and movement of a new stack thereon, followed by partial raising of the platform properly to adjust the height of the top of the stack, no feeding of veneer sheets can occur and the dryer, in effect, is unused. With the cost of operating a veneer dryer being substantial, obviously substantial savings are realized if such periods of dryer non-use are eliminated.

Generally, therefore, an object of this invention is to provide apparatus for supporting a stack of veneer sheets which accommodates the recharging of a new stack of veneer sheets on a platform in the apparatus without interuption of the removal of sheets from the top of a stack remnant supported in the apparatus.

Another object of the invention is to provide apparatus for feeding veneer sheets into a dryer, which provides an uninterrupted supply of sheets at a predetermined elevation, ready for movement of sheets from the supply periodically between pinch rolls adapted to initiate movement of such sheets into the dryer.

An important feature of the apparatus of the invention is that is requires substantially no more space in a dryer installation than constructions that are presently in use which are devoid of the capability of recharging a stack while the feed of veneer sheets into the dryer continues.

Yet another object of the invention is to provide a stack supporting apparatus as above-described characterized by a construction which is relatively free of moving parts exposed in such a manner as to be hazardous to operating personnel.

More specifically, an object of the invention is to provide apparatus for supporting a stack of sheets, such as veneer sheets, which includes an elevatable platform adapted to be charged with a new stack of sheets in a lowered position and then to be raised to place the top of the stack at a desired level, and an accumulator means engagable with the underside of a partially depleted stack independently of the platform, whereby such may be lowered to be charged with a new stack of sheets. Specifically, such accumulator means comprises hoist bars carried by the platform actuatable to lift a partially depleted stack of sheets from the support plane of the platform, and holding arms or bars that are actuatable to move from an inoperative position to an operative position wherein such come up underneath the remnant stack lifted by the hoist bars. The platform is lowerable after the holding arms have been properly positioned, to leave the stack remnant entirely supported by the holding arms. With lowering of the platform, such may be charged with a new stack of veneer.

The invention further contemplates guide structure for the holding arms, with guideways provided for each of the opposite ends of the arms, and powered means for moving such arms along the paths defined by such guideways.

These and other objects and advantages are obtained by the invention, which is described here and below in conjunction with the accompanying drawings, wherein:

DETAILED DESCRIPTION OF A PREFERRED EMBODIMENT OF THE INVENTION

Figures 1, 2, 3:
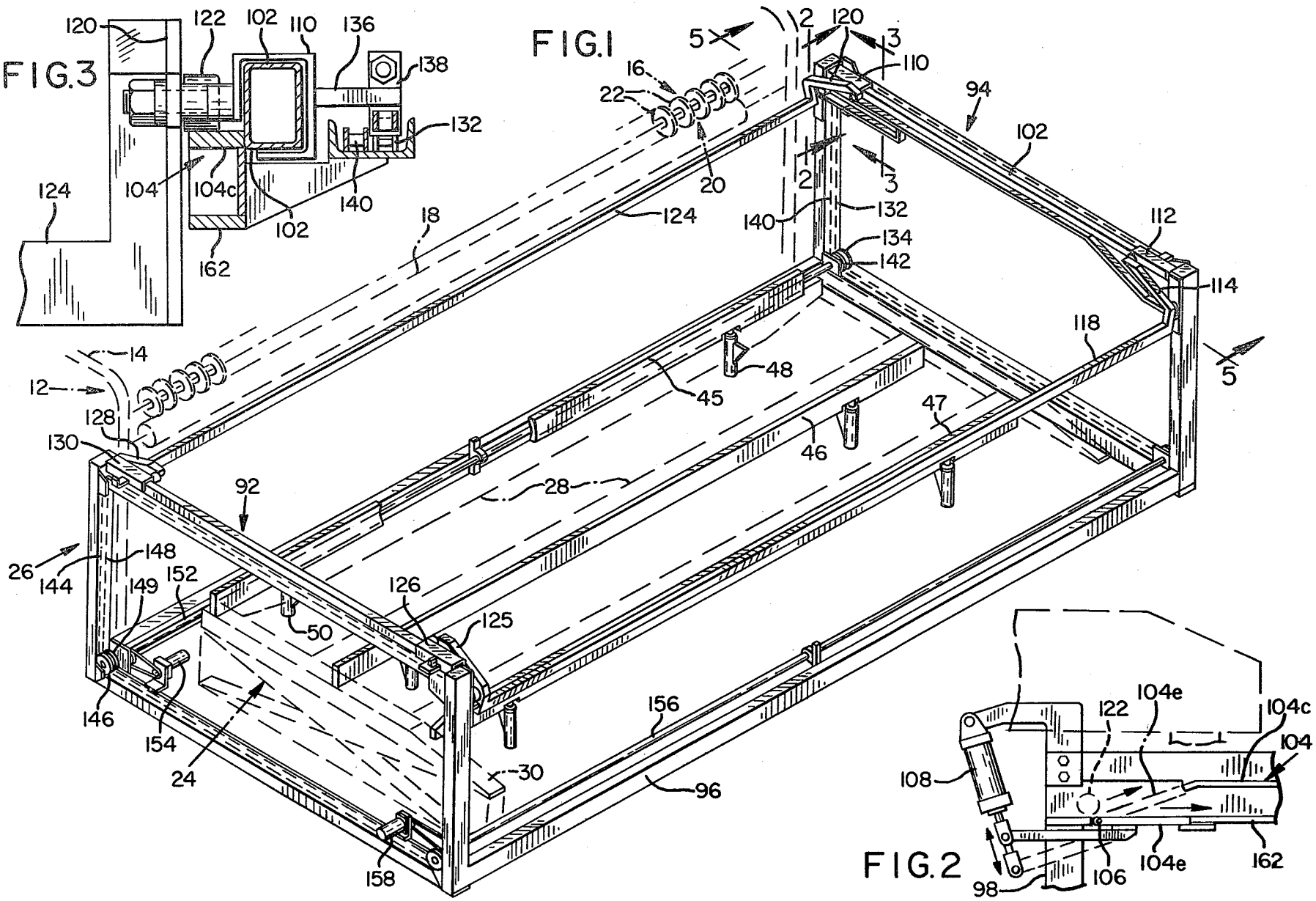
FIG. 1 is a perspective view illustrating, in somewhat simplified form and with parts of the structure removed, apparatus as comtemplated herein.
FIG. 2 is a cross-sectional view, taken generally along the line 2—2 in FIG. 1 illustrating in greater detail portions of guide structure in the apparatus.
FIG. 3 is a cross-sectional view, taken generally along the line 3—3 in FIG. 1.

Referring more particularly to FIG. 1, portions of a veneer sheet feeder of a type that is currently utilized in the feeding of charges of veneer sheets to successive decks in a dryer are shown at 12. Such may include the usual frame 14 and supported in this frame, in a position elevated above the ground, a pinch roll mechanism 16. This pinch roll mechanism may include an elevated, horizontal, smooth-surfaced bottom roll 18, and disposed above it a horizontal top roll 20. The top roll, instead of being smooth-surfaced, may be made up of a series of axially aligned rubber tires, such as those shown at 22, mounted on a common shaft.

Further describing the dryer feeder, as is conventional, means is provided for rotating constantly the lower smooth-surfaced roll 18. Further, the upper or top roll 20, which ordinarily is an idler roll, is mounted in such a way that it may be swung upwardly and away from a position directly over the lower roll. With the upper roll moved away from the lower roll, the forward ends of the various veneer sheets in a charge of veneer may be moved to place these ends over the lower roll. At such time as a deck in the dryer is ready to receive a charge, the top roll is moved downwardly against the bottom roll to pinch the ends of the veneer sheets residing between the rolls. When this occurs, their forward progress into the dryer is initiated. Details of such a dryer feeder, and how such may be employed in the supplying of veneer sheets to successive decks in a dryer, are discussed in Jeddeloh U.S. Pat. No. 2,876,009.

Figure 4:
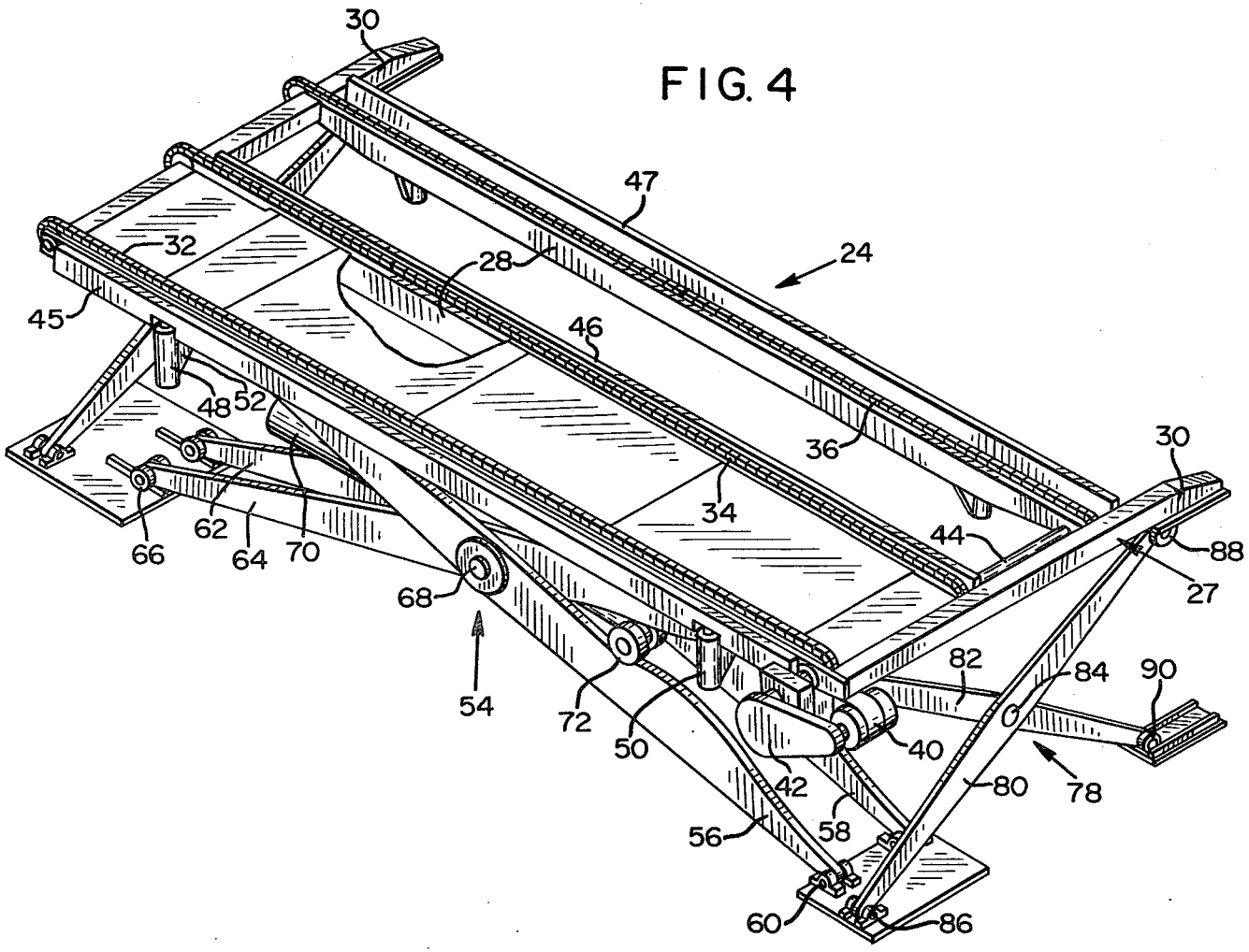
FIG. 4 is a perspective view illustrating a form of elevatable platform means which is part of the apparatus contemplated.

This invention contemplates equipment for holding a stack of veneer sheets on the feed side of the dryer feeder, comprising an elevatable platform means equipped with hoist bars, given the general reference numeral 24, and a frame encompassing this platform means and provided with holding bars, given the general reference numeral 26. In FIG. 1 the platform means is only partially illustrated in very simplistic form. In FIG. 4, the platform means is illustrated in a perspective view in greater detail.

Referring to FIG. 4, and considering initially the construction of the platform means, such comprises a rectangular frame 27 made up of longitudinally extending beams 28, and transversely extending beams 30 interconnecting beams 28 adjacent their ends. Guided for travel along the upper portions of beams 28 are the upper reaches of elongate, continuous, conveyor chains 32, 34, and 36. Opposite extremities of these chains are trained over suitable sprockets. A motor 40, mounted on the under side of frame 27, is drivingly connected by a power transmitting mechanism 42 to a shaft 44 which has the sprockets training the lower extremities of chains 32, 34 and 36 (as viewed in FIG. 4) secured thereto.

The upper reaches of chains 32, 34 and 36 define the load supporting plane of the platform formed by beams 28, 30 and the conveyor chains. The conveyor chains are employed to facilitate the loading of a stack of veneer sheets onto the platform.

With continued reference to FIG. 4, the apparatus illustrated further includes plural elongate hoist bars 45, 46, 47 extending in the direction of beams 28. Specifically, one such hoist bars extends along side each longitudinal beam 28. Each hoist bar, adjacent each of its opposite ends, is mounted on the extensible or rod end of a ram, as exemplified by rams 48, 50. The cylinders of these rams are mounted, as through gussets 52, on the longitudinal beams in the platform. In this way, the hoist bars, collectively referred to herein as hoist means, are carried by the platform to partake in any upward or downward movement imparted to the platform.

With the various rams 48 contracted and the hoist bars in their lowered positions, their upper surfaces are at or only slightly below the support plane defined by the conveyor chains. Extension of the rams moves the hoist bars so that their upper surfaces are above this support plane, as will later be more fully described.

The platform is raised and lowered through operation of a scissor mechanism shown at 54. Such comprises a first set of scissor arms 56, 58, anchored to the floor by pivot connections 60, and having an opposite set of ends provided with rollers which ride on the underside of the platform. The mechanism further includes a second set of scissor arms 62, 64, with rollers 66 mounted on one set of their ends riding on guide structure on the floor, and pivot connections pivotally anchoring the other set of ends to the underside of the platform. The sets of arms are interconnected by pivot means 68. Supported by this pivot means is a cylinder of an extensible ram 70 which has a cam roller means 72 mounted on the rod end thereof. With contraction of ram 70, the roller means is brought inwardly toward pivot means 68 to cause the sets of arms to swing to a move diverging position with raising of the platform. Conversely, extension of the ram moves the roller means outwardly whereby the arms, under gravity, may swing to a more aligned position with lowering of the platform.

Supporting the ends of the platform and preventing the same from tilting are equalizer scissor mechanisms, such as the equalizer scissor mechanism shown at 78. Such includes a pair of crossed arms 80, 82, pivotally interconnected by pivot means 84. The lower end of arm 80 is pivoted to the floor by pivot means 86 and has its upper end guided for movement on the underside of the platform by roller means 88. Arm 82, on the other hand, has its upper end pivotally connected to the underside of the platform and its lower end guided for rolling movement on the floor by roller means 90.

As earlier explained, the platform means is not shown in its entirety in FIG. 1 in order better to illustrate encompassing frame 26. However, the hoist bars 45, 46, 47 of the platform apparatus have been shown in FIG. 1 in solid outline, as well as portions of frame 27, as exemplified by the dashed outline of longitudinal beams 28 and transversely extending beams 30. The longitudinals define opposite sides of the platform which parallel the pinch roll mechanism, as do the hoist bars, 45, 46, 47. A stack or stacks of veneer sheets may be deposited on the platform, individual sheets having their long dimension, i.e. direction of their grain, extending across longitudinals 28 (and across the upper reaches of the chains which extend along the lengths of these longitudinal beams).

Referring again to FIG. 1, encompassing frame 26 includes an upstanding end section 92 which is adjacent to one side of the dryer feeder 12, and another upstanding end section 94, which is adjacent the opposite side of the dryer feeder. These end sections are rigidly interconnected as by interconnecting beams 96. The end sections of frame 26 are similar in construction.

Figure 5:
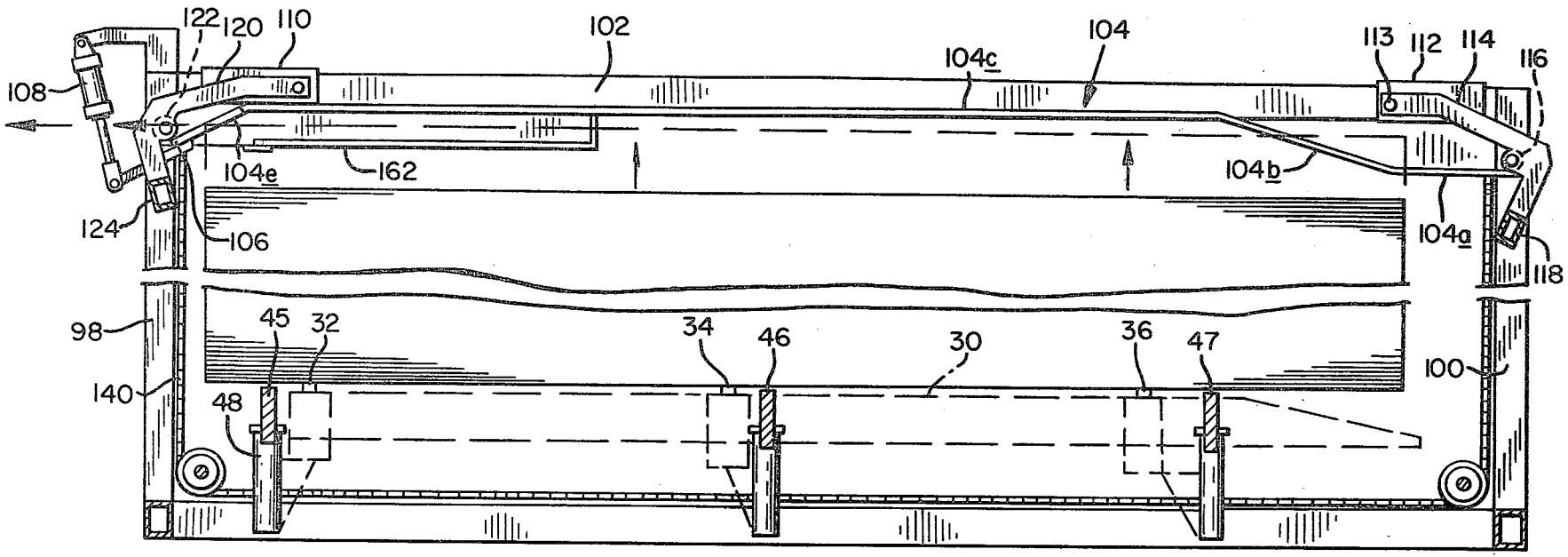
FIG. 5 is an elevation of the appartus, somewhat simplified, as such would appear viewing from the line 5—5 in FIG. 1.
Figure 6:
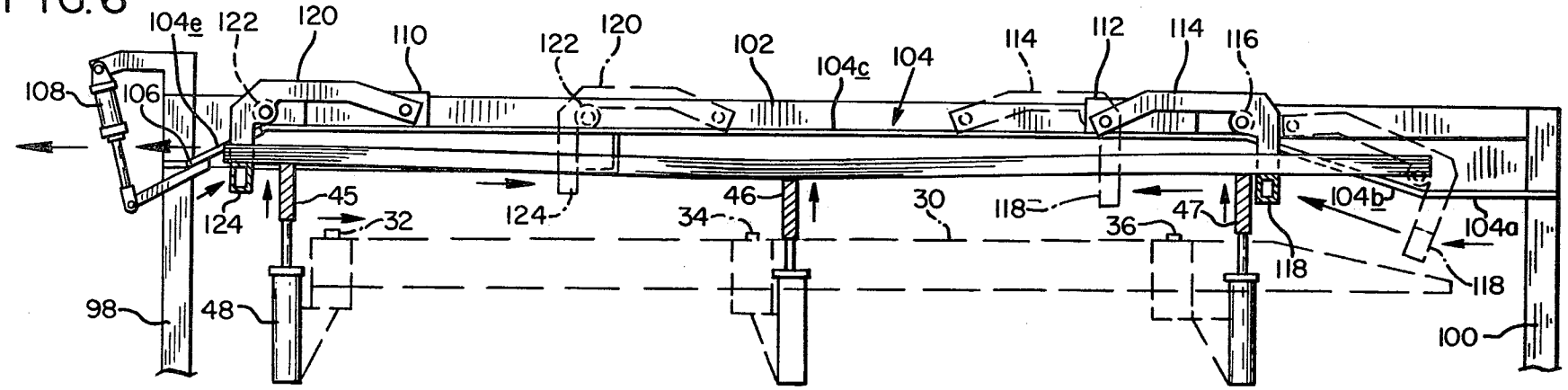
FIG. 6 is a view similar to upper portions of FIG. 5, but showing the apparatus as it would appear during one stage of handling a remnant stack of veneer sheets.
Figure 7:
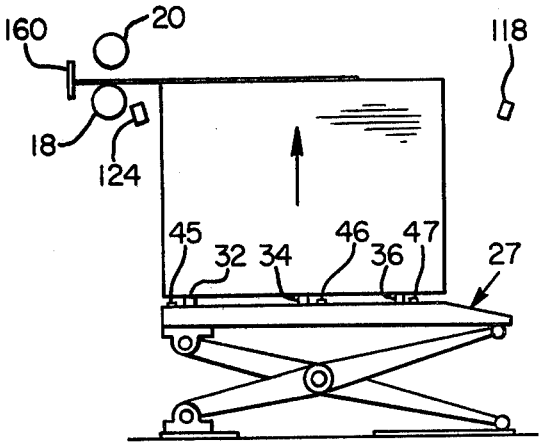
FIGS. 7–12 are simplified end views of the apparatus and illustrating different adjusted positions for the apparatus, which the apparatus undergoes in the handling of veneer sheets.

Referring now more particularly to FIGS. 5 and 6 for a description of end section 94, such includes upstanding posts 98, 100, rigidly interconnected adjacent their top ends by a beam 102. Provided along a side of this beam is elongate guide rail structure 104.

Referring to FIG. 5, and progressing from right to left in the figure, structure 104 includes a horizontal portion **104*a*, joining with an upwardly inclined portion 104*b*, which in turn joins with an elongate horizontal portion 104*c* joining with an inclined portion 104*e*. Portion 104*e* is pivotally mounted on the frame by pivot 106 and is placed in different adjusted positions by actuation of a ram 108. In the most usual mode of operation, portion 104*e* occupies the inclined position which it has in FIG. 5, where such meets with horizontal portion 104*c***.

Mounted for movement along the length of beam 102 are a pair of guide sleeves 110, 112. Pivotally mounted by pivot 113 on sleeve 112, is an arm 114 mounting a roller 116 which rides on right hand portions of the guide rail structure in FIG. 5. Secured to the lower end of arm 114 is one end of a holding arm 118. Similarly, pivotally mounted on sleeve 110 is an arm 120, mounting a roller 122 riding on left hand portions of the guide rail structure. Secured to the bottom end of arm 120 is one end of another holding arm 124.

Referring again to FIG. 1, holding arm 118 has its opposite end secured to an arm 125 similar to arm 114 just-described, which is pivotally secured to a guide sleeve 126 similar to sleeve 112. The opposite end of holding arm 124 is secured to an arm 128 similar to arm 120 pivotally mounted on a guide sleeve 130 similar to sleeve 110.

With the construction described, on inward movement of sleeve 112 and similar movement in its counterpart 126, holding arm 118 is caused to move inwardly as shown in FIG. 6. Movement of sleeve 110 inwardly on the frame and similar movement in its counterpart sleeve 130, produces inward and upward movement of holding arm 124.

Referring now to FIGS. 1 and 3, a chain shown at 132 extends around the perimeter of end section 92 and is trained over a sprocket provided at each corner of the end section, as exemplified by sprocket 134. Opposite ends are secured to sleeve 110 utilizing pin 136 and bracket 138 illustrated in FIG. 3. A similar chain 140 is trained around the perimeter of the end section of the frame, trained over a sprocket at each corner of the frame section as by sprocket 142. This chain has ends secured to sleeve 112.

At the opposite end of frame 26, a chain 144 is provided similar to chain 132 secured to sleeve 130 and trained over sprockets provided at the corners of the end section exemplified by sprocket 146. Another chain 148 is secured to sleeve 126 such being trained over sprockets including sprocket 149.

A shaft 152 extends between the two frame end sections, which has sprocket 146 training chain 144 secured to the shaft for rotation therewith at one end, and which has sprocket 134 training chain 132 secured to the shaft for rotation therewith at its opposite end. A hydraulic motor 154 may be actuated to rotate the shaft and these two sprockets. Thus, on actuation of the motor, chains 144, 132 are caused to move in unison with concurrent movement of sleeves 110, 130 along the beams that support them. Such rotation of the shaft 152 does not affect sprockets 149, 142 since these sprockets are journaled on the shaft. A similar shaft 156 at the other side of the machine is rotated through actuation of a hydraulic motor 158. The sprockets secured to this shaft, which are rotated with rotation of the shaft, are those training chains 148, 140 secured to sleeves 112, 126. Thus, actuation of the motor 158 produces concurrent movement of sleeves 126, 112.

Reference is now made to FIGS. 7–12 in explaining how the apparatus described may be utilized in the feeding of veneer sheets to a dryer. Initially, the platform, comprising frame 27 and the chain defining the support plane in the platform, is lowered. A stack of veneer sheets is then deposited thereon. The stack usually contains multiple sheets in each layer, disposed side-by-side, with the grain and length of the sheets extending transversely of the chains, so that ends of these sheets are located on the side of the stack facing the pinch roll mechanism.

With the stack so positioned, the platform is elevated to bring the top of the stack to approximately the height of the pinch rolls 18, 20. With the pinch rolls spaced apart, the operator pushes sheets from the top of the stack so that lead ends of the sheets pass over the smooth-surfaced bottom roll 18 and up against a fence 160, which the dryer feeder has and which moves downwardly to provide an abuttment for the forward ends of the sheets with pinch roll 20 raised. With a charge of sheets positioned on lower roll 18, and on command that a deck in the dryer is ready for receiving a charge, upper pinch roll 20 drops downwardly and fence 160 lifts. The sheets in the charge are pinched between the two rolls and have their forward progress initiated. Platform 27 is raised incrementally to maintain the top of the stack at the desired height.

Figure 8:
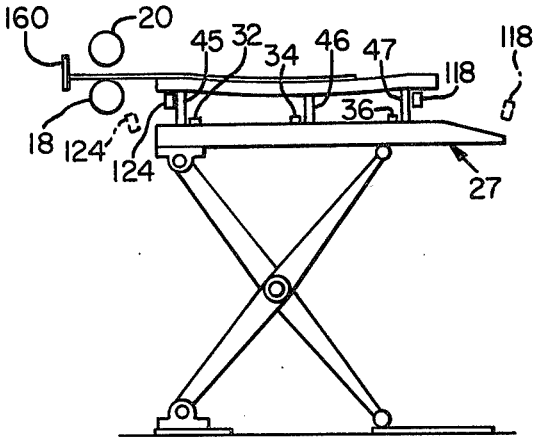
Figure 9:
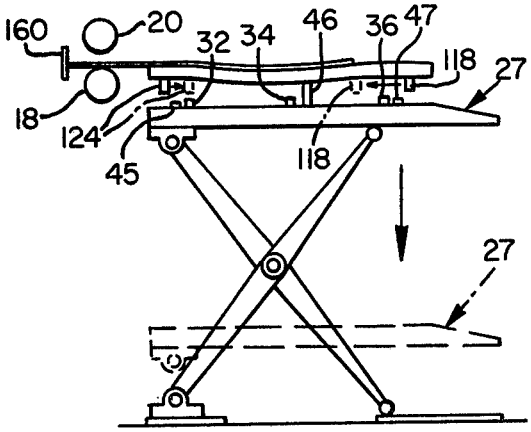

On platform 27 reaching the height illustrated in FIG. 8, further upward movement of the stack may be produced by elevating the hoist bars relating to the platform. Again, such may be done incrementally, to maintain the top of the stack remnant at approximately the height of the pinch roll mechanism. Ordinarily, the outer pair of hoist bars are raised a slightly higher distance than the center hoist bar, with maximum lift of the outer bars being, for instance, six inches, and maximum lift of the center bar being, for instance, four inches. With the hoist bars fully raised, the holding bars or arms 124, 118 are moved inwardly and upwardly from their inoperative positions, shown in dashed outline in FIG. 8, to their operative positions, shown in solid outline in FIG. 8. Typically, there is some dropping in the sheets of a remnant stack, and this inward and upward movement of the holding arms permits them to clear any droop in the outer regions of the stack.

Figure 10:
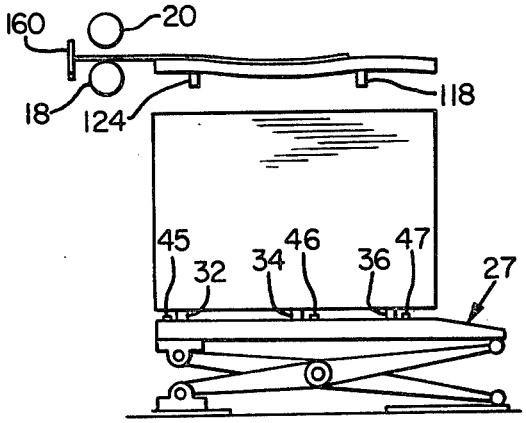
Figure 11:
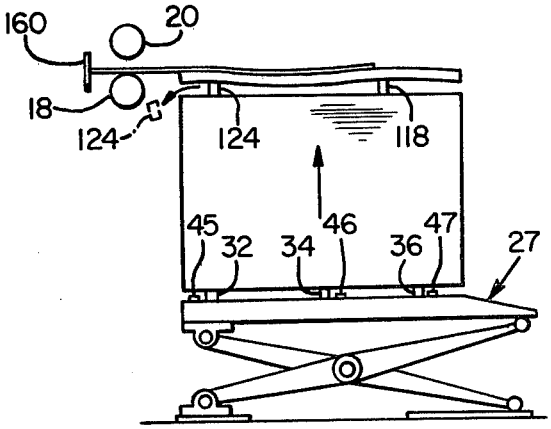
Figure 12:
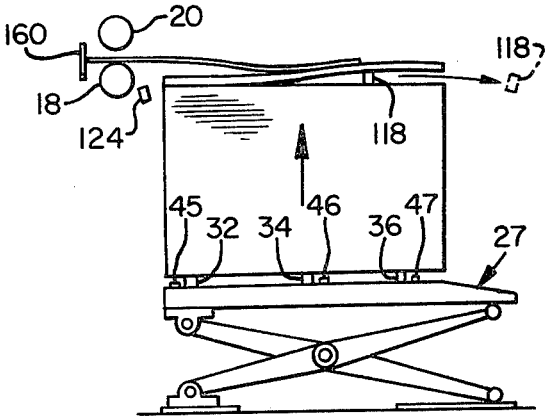

With the holding bars occupying the position shown in solid outline in FIG. 8, the outer hoist bars may be lowered, which results in the stack now being supported at its outer side extremities by the holding bars, and along a central region by the still raised hoist bar 46. The holding bars may then be further shifted inwardly to place them in the position shown in dotted outline in FIG. 9. After such positioning, the platform may be lowered with the remnant stack now being entirely supported on the holding bars as shown in FIG. 10. With such a condition reached, the platform is ready for the reception of a new stack of veneer sheets. With the new stack being raised to adjacent the lower surfaces of the holding bars, bar 124 may be then shifted outwardly and downwardly to the position shown in dashed outline in FIG. 11. This places one margin of the remnant stack on the new stack as shown in FIG. 12. After such occurs, the other holding bar may be moved laterally outwardly and downwardly from the position of the bar shown in solid outline to the position shown in dotted outline in FIG. 12. This results in the remnant stack being entirely supported on the new stack. Feeding of sheets from the top of the remnant stack may be continued throughout this entire process.

In some installations, feeding of sheets from the stack may be performed using a vacuum device which drops down on the top of the stack to produce automatic feeding of sheets. In such an installation, it may be desirable to have the margin of the stack which is adjacent the pinch rolls at a lower elevation then when manual feeding of sheets is performed. To accomplish this, ram 108 controlling the position of guide rail portion 104*e* of the guide rail structure may be contracted. This positions portion 104*e* in a horizontal position, as shown in FIG. 2, the portion now becoming aligned with horizontal guide rail 162. With such an adjustment made, and on movement of the sleeve which produces movement of roller 122, holding arm 124 moves inwardly along a horizontal path at a lower elevation.

It will be apparent from the above, that with the apparatus described, more efficient use of a dryer is possible, since feeding of sheets from a stack remnant can continue during the time that a new stack is being deposited on the platform. The apparatus contemplated does not take up appreciably more room than the ordinary platform employed for supporting veneer stacks in conventional constructions. Modification of an existing facility to provide for the continuous feed of sheets is a relatively simple matter.

While a specific embodiment of the invention has been described, obviously modifications and variations are possible without departing from the invention.

It is claimed and desired to secure by Letters Patent:

1. Apparatus for feeding veneer to a dryer comprising:

pinch roll means including an elevated horizontal bottom roll means adapted to have the leading ends of veneer sheets in a charge positioned in overlying relation thereto, and a horizontal top roll means disposed over said bottom roll means in spaced relation thereto, said pinch roll means further including means associated with one of said roll means for periodically shifting the same toward the other roll means, thus to pinch the leading ends of veneer sheets and initiate their forward travel into a dryer, elevatable platform means located on the feed side of said pinch roll means for holding a stack of veneer sheets with opposite sides of the stack substantially paralleling the pinch roll means and with the top of the stack at approximately the height of the bottom roll means whereby to facilitate movement of sheets to place their leading ends in overlying relation to the bottom pinch roll means and also to provide support for the trailing ends of sheets so positioned, and accumulator means engageable with the bottom of a stack of veneer sheets held on said platform means operable with the platform means partially elevated to lift and hold a stack of sheets independently of said platform means, thus to accommodate lowering of the platform means to ready the platform means for the reception of a new stack of veneer sheets said accumulator means comprising hoist means carried by said elevatable platform means actuatable to lift a stack of sheets from the support plane of the platform means, and holding means mounted independently of said elevatable platform means actuatable to come under a stack of sheets lifted by said hold means, and to engage side margins of the stack's bottom that parallel said sides of the stack thus to hold said stack elevated from the support plane of the platform means.

2. The apparatus of claim 1, wherein said hoist means comprises elongate, laterally spaced hoist bars substantially paralleling the pinch roll means and motor means interposed between the hoist bars and platform means actuatable to elevate the hoist bars above the support plane of the platform means, and wherein said holding means comprises a stationary frame disposed outwardly of said platform means, elongate laterally spaced holding bars substantially paralleling the pinch roll means, and motor means interposed between said stationary frame and said holding bars actuatable to bring said holding bars under a stack of sheets lifted by said hoist means.

3. Apparatus for feeding veneer sheets to a veneer dryer comprising:

an elevated power-driven substantially horizontal pinch roll mechanism having upper and lower roll means spaced apart from each other to provide a space into which the lead ends of veneer sheets may be placed and moveable toward each other to produce pinching of veneer sheets placed between the rolls and to initiate forward travel of the sheets, and elevatable elongate platform means on the feed side of said pinch roll mechanism disposed substantially parallel to said pinch roll mechanism, said platform means having a lowered position and including conveyor means for moving a stack of veneer sheets onto said platform means with such in its lowered position, and for supporting the stack with the stack on said platform means, the conveyor means defining the support plane of the platform means, said platform means being raisable to place the top of a stack supported thereon at approximately the height of the pinch roll mechanism and to maintain this relationship as the height of the stack decreases, and accumulator means for lifting and then holding a stack independently of said platform means, thus to accommodate lowering of the platform means for the reception of a new stack of veneer sheets, said accumulator means comprising hoist means carried by a said elevatable platform means actuatable to lift a stack of veneer sheets from the support plane of the platform means, and stack holding means supported independently of said platform means actuatable to move under a stack of sheets lifted by said hoist means and thence to hold said stack elevated with subsequent lowering of the platform means.

4. The apparatus of claim 3, wherein said hoist means comprises elongate laterally spaced hoist bars substantially paralleling the pinch roll mechanism and means interposed between hoist bars and platform means actuatable to elevate the bars above the support plane of the platform means, and wherein said holding means comprises a stationary frame disposed outwardly of said platform means, elongate laterally spaced holding bars substantially paralleling the pinch roll mechanism, and motor means interposed between said stationary frame and said holding bars actuatable to move said holding bars under a stack of sheets lifted by said hoist means.

5. Apparatus for feeding veneer sheets to a dryer comprising:

an elevated power-driven substantially horizontal pinch roll mechanism for feeding veneer sheets into the dryer, an elevatable platform means on the feed side of such pinch roll mechanism having a support plane for supporting a stack of veneer sheets and having a set of opposite sides substantially paralleling the pinch roll mechanism, multiple elongate hoist bars extending in the direction of said sides of the platform means and spaced laterally over the expanse of said platform means, means mounting said hoist bars on said platform means, said mounting means for said bars including means for shifting under power each bar between a lowered position which is no higher than said support plane and a raised position disposed above said support plane, the hoist bars collectively in said raised position defining a plane located above said support plane, a pair of holding bars disposed laterally outwardly of said opposite sides of said platform means, and means mounting said holding bars independently of said platform means, the mounting for said holding bars including means for shifting them from an inoperative position disposed remotely from the sides of the platform means to an operative position disposed closely adjacent the sides of said platform with the platform means in an elevated position.

6. The apparatus of claim 5, wherein the means mounting said holding bars comprises a stationary frame disposed outwardly of the sides of said platform means, guide structure on said stationary frame defining paths of movement for said holding bars from their said inoperative to operative positions, and powered means for moving said holding bars in said paths defined by said guide structure.

7. The apparatus of claim 6, wherein said guide structure for each holding bar includes a guideway for each of the opposite ends of the bar.

8. Apparatus for supporting stacks of veneer sheets accommodating removal of sheets from the top of the stack at a substantially uniform elevation comprising;

a frame, an elevatable platform having a support plane supported on said frame, and means for raising and lowering said platform under power, an array of multiple elongate hoist bars extending in the direction of one set of sides of said platform and spaced laterally over the expense of said platform, means mounting said hoist bars on said platform including means for shifting them under power from a lowered position which is no higher than said support plane and a raised position disposed above said support plane, a pair of holding bars disposed laterally outwardly of said set of sides of said platform means, and means mounting said holding bars independently of said platform, the mounting for said holding bars including means for shifting them from an inoperative position disposed remotely from said set of sides of said platform with the platform elevated from the ground to an operative position disposed closely adjacent to said set of sides of said platform with the platform so elevated.

9. The apparatus of claim 8, wherein the mounting for said holding bars comprises a stationary frame disposed outwardly of said platform, and guide structure on said frame for guiding said holding bars for movement between their inoperative and operative positions.

10. The apparatus of claim 9, wherein the means for shifting said bars comprises, for each bar, powered means connected to each end of the bar.

* * * * *